US010697707B2

(12) United States Patent
Sekiguchi et al.

(10) Patent No.: US 10,697,707 B2
(45) Date of Patent: Jun. 30, 2020

(54) HEAT EXCHANGE MEMBER AND HEAT EXCHANGER

(71) Applicant: KYOCERA Corporation, Kyoto-shi, Kyoto (JP)

(72) Inventors: Keiichi Sekiguchi, Kyoto (JP); Yuusaku Ishimine, Kyoto (JP); Kazuhiko Fujio, Kyoto (JP)

(73) Assignee: KYOCERA Corporation, Kyoto (JP)

( * ) Notice: Subject to any disclaimer, the term of this patent is extended or adjusted under 35 U.S.C. 154(b) by 553 days.

(21) Appl. No.: 15/107,046

(22) PCT Filed: Dec. 22, 2014

(86) PCT No.: PCT/JP2014/083951
§ 371 (c)(1),
(2) Date: Jun. 21, 2016

(87) PCT Pub. No.: WO2015/093619
PCT Pub. Date: Jun. 25, 2015

(65) Prior Publication Data

US 2017/0038148 A1 Feb. 9, 2017

(30) Foreign Application Priority Data

Dec. 21, 2013 (JP) ..... 2013-264717

(51) Int. Cl.
*F28D 1/053* (2006.01)
*F28F 1/42* (2006.01)
(Continued)

(52) U.S. Cl.
CPC ..... *F28D 1/05383* (2013.01); *F28F 1/42* (2013.01); *F28F 21/04* (2013.01); *F28F 2001/027* (2013.01); *F28F 2255/18* (2013.01)

(58) Field of Classification Search
CPC ..... F28D 1/05383; F28F 1/42; F28F 21/04; F28F 2001/027; F28F 1/10; F28F 1/40;
(Continued)

(56) References Cited

U.S. PATENT DOCUMENTS 5,251,692 A 10/1993 Haussmann
5,909,766 A 6/1999 Kobayashi et al.
(Continued)

FOREIGN PATENT DOCUMENTS

DE 103 31 518 A1 1/2004
EP 0 519 334 A2 12/1992
(Continued)

OTHER PUBLICATIONS

International Search Report and Written Opinion of the International Searching Authority issued by the Japanese Patent Office for International Application No. PCT/JP2014/083951.
(Continued)

*Primary Examiner* — Jon T. Schermerhorn, Jr.
(74) *Attorney, Agent, or Firm* — Procopio Cory Hargreaves and Savitch LLP

(57) ABSTRACT

A heat exchange member includes: a lid portion; a bottom plate portion; a plurality of partition portions disposed so as to connect the lid portion and the bottom plate portion, a part surrounded by the lid portion, the bottom plate portion and the partition portion defining a first flow passage through which a first fluid flows; a curved portion curved toward the first flow passage on a first flow passage side of at least one of the lid portion and the bottom plate portion when viewed in a cross section perpendicular to a direction in which the first fluid flows.

14 Claims, 4 Drawing Sheets

(51) Int. Cl.
*F28F 21/04* (2006.01)
*F28F 1/02* (2006.01)

(58) Field of Classification Search
CPC .... F28F 3/04; F28F 3/042; F28F 3/046; F28F 3/14
See application file for complete search history.

(56) References Cited

U.S. PATENT DOCUMENTS

| | | | | |
|---|---|---|---|---|
| 6,470,964 | B1 * | 10/2002 | Nakado | F28D 1/0391 165/133 |
| 6,546,998 | B2 * | 4/2003 | Oh | F28D 1/0535 165/110 |
| 7,500,515 | B2 * | 3/2009 | Tsuji | B21D 39/06 165/173 |
| 8,776,874 | B2 * | 7/2014 | Hu | F28D 1/0443 165/146 |
| 2001/0020365 | A1 | 9/2001 | Kubo et al. | |
| 2003/0141048 | A1 | 7/2003 | Lee et al. | |
| 2004/0035562 | A1 | 2/2004 | Nishijima et al. | |
| 2004/0200229 | A1 | 10/2004 | Kubo et al. | |
| 2008/0105420 | A1 * | 5/2008 | Taras | F25B 39/00 165/174 |
| 2008/0135218 | A1 | 6/2008 | Taniguchi et al. | |
| 2009/0087604 | A1 * | 4/2009 | Stewart | B21C 23/085 428/35.8 |
| 2009/0159253 | A1 * | 6/2009 | Hu | F28D 1/0443 165/173 |
| 2010/0051249 | A1 | 3/2010 | Taniguchi et al. | |
| 2010/0051250 | A1 | 3/2010 | Taniguchi et al. | |

FOREIGN PATENT DOCUMENTS

| | | | | |
|---|---|---|---|---|
| EP | 1 136 781 | A1 | | 9/2001 |
| FR | 2 799 824 | A1 | | 4/2001 |
| FR | 2813663 | A1 | | 3/2002 |
| JP | U54-139351 | | | 6/1979 |
| JP | U57-154872 | | | 9/1982 |
| JP | 61072679 | A | * | 4/1986 |
| JP | U61-181210 | | | 11/1986 |
| JP | 63-091492 | A | | 4/1988 |
| JP | U02-109177 | | | 8/1990 |
| JP | 04-369396 | A | | 12/1992 |
| JP | 06-082124 | A | | 3/1994 |
| JP | 11-023100 | A | | 1/1999 |
| JP | 11-337276 | A | | 12/1999 |
| JP | 2001-174184 | A | | 6/2001 |
| JP | 2001-255027 | A | | 9/2001 |
| JP | 2005-300062 | A | | 10/2005 |
| JP | 2006-313030 | A | | 11/2006 |
| JP | 2009-068742 | A | | 4/2009 |

OTHER PUBLICATIONS

Extended European Search Report dated Oct. 12, 2017, issued by the European Patent Office in counterpart European Patent Application No. 14 871492.6.

* cited by examiner

HEAT EXCHANGE MEMBER AND HEAT EXCHANGER

TECHNICAL FIELD

The present invention relates to a heat exchange member and a heat exchanger.

BACKGROUND ART

Conventionally, heat exchangers used for various kinds of cooling systems and the like have been shown as examples. As such a heat exchanger, for example, there is exemplified a heat exchanger comprising a plurality of long plates disposed substantially parallel to one another and slits disposed between the long plates wherein a plurality of boards provided with concaves so as to be continuous in the longitudinal direction on the surfaces of some of the long plates, are laminated, the long plates of the adjoining boards are connected together to form tubes, the concaves form inside-tube flow passages and the slits form outside-tube flow passages (for example, see Patent Literature 1).

CITATION LIST

Patent Literature

Patent Literature 1: Japanese Unexamined Patent Publication JP-A 2005-300062

SUMMARY OF INVENTION

Technical Problem

At present, as a heat exchanger of an above described configuration, a heat exchanger with further improved heat exchange efficiency is required.

Accordingly, an object of the invention is to provide a heat exchange member with improved heat exchange efficiency and a heat exchanger provided with the same.

Solution to Problem

A heat exchange member according to one embodiment of the invention comprises: a lid portion; a bottom plate portion; a plurality of partition portions disposed so as to connect the lid portion and the bottom plate portion, a part surrounded by the lid portion, the bottom plate portion and the partition portion defining a first flow passage through which a first fluid flows; and a curved portion curved toward the first flow passage on a first flow passage side of at least one of the lid portion and the bottom plate portion when viewed in a cross section perpendicular to a direction in which the first fluid flows.

Moreover, a heat exchanger according to another embodiment of the invention comprises a plurality of flow passage members at space intervals therebetween, through which a first fluid flows, the space intervals defining second flow passages through which a second fluid flows, at least one of the flow passage members being composed of the heat exchange member of the above-described structure; an inlet member which communicates with the first flow passage at one end sides of the respective flow passage members and directs the first fluid into the respective flow passage members; and an outlet member which communicates with the first flow passage at other end sides of the respective flow passage members and directs the first fluid out of the respective flow passage members.

Advantageous Effects of Invention

According to the heat exchange member of the invention, since the curved portion is provided, a heat exchange member with improved heat exchange efficiency can be obtained.

Moreover, according to the heat exchanger of the invention, since at least one of the flow passage members through which the first fluid flows is composed of the heat exchange member of the above-described structure, a heat exchanger with improved heat exchange efficiency can be obtained.

DESCRIPTION OF EMBODIMENTS

Hereinafter, a heat exchanger of the present embodiment will be described with reference to the drawings.

Figure 1:
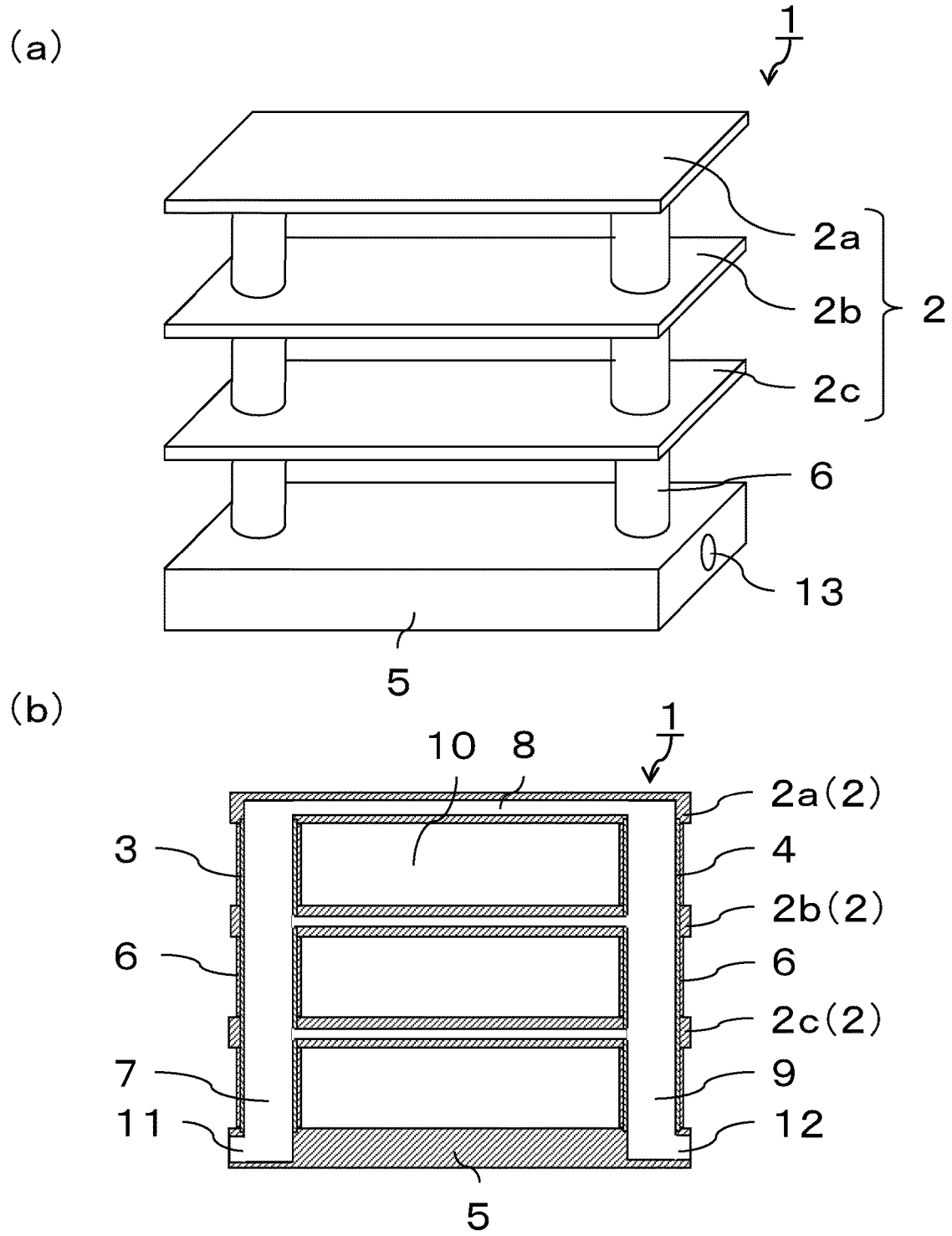
FIG. 1(*a*) is an external perspective view showing an example of a heat exchanger of the present embodiment, and FIG. 1(*b*) is a cross-sectional view thereof.
Figure 2:
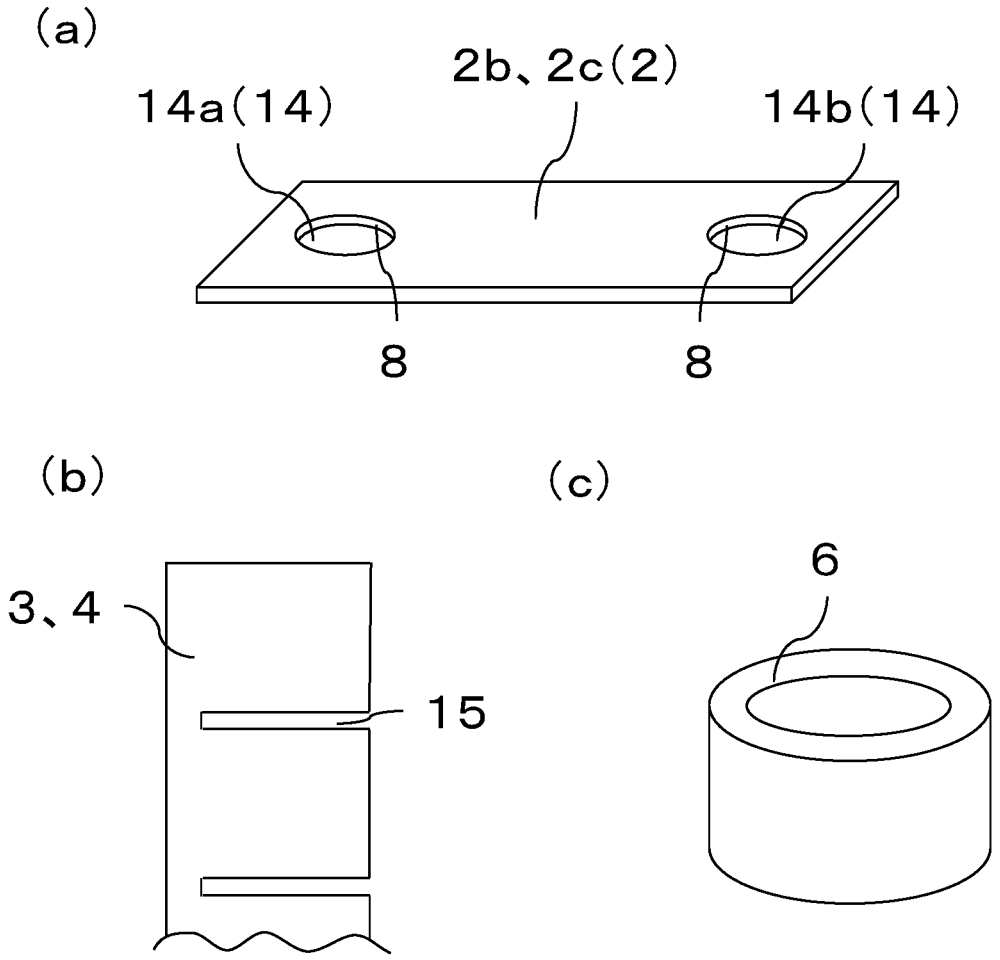
FIGS. 2(*a*) to (*c*) show extracts of members constituting the heat exchanger shown in FIG. 1, wherein FIG. 2(*a*) is a perspective view showing an example of a heat exchange member, FIG. 2(*b*) is a side view showing an example of an inlet member and an outlet member, and FIG. 2(*c*) is a perspective view showing an example of a covering member.

FIG. 1(*a*) is an external perspective view showing an example of the heat exchanger of the present embodiment, FIG. 1(*b*) is a cross-sectional view thereof, FIG. 2(*a*) shows a perspective view showing an example of a heat exchange member of the heat exchanger shown in FIG. 1, FIG. 2(*b*) shows a side view showing an example of an inlet member and an outlet member thereof, and FIG. 2(*c*) shows a perspective view showing an example of a covering member thereof. In the following drawings, the same members are denoted by the same reference numerals.

In the heat exchanger 1 shown in FIG. 1, members are formed of a ceramic sintered body. Since the heat exchanger 1 is formed of a ceramic sintered body as mentioned above, a heat exchanger excellent in heat resistance and corrosion resistance can be realized. As such a ceramic sintered body, a ceramic sintered body is selected as appropriate according to the usage environment and the fluid characteristics for use; for example, not only a silicon carbide-based sintered body whose main ingredient is silicon carbide, but also an alumina-based sintered body whose main ingredient is alumina, or the like may be used. The main ingredient referred to here is, of all the ingredients constituting the sintered body, an ingredient contained not less than 70 mass %, and in the case of a silicon carbide-based sintered body, when the value obtained by conversion of the content of silicon or carbon obtained by a quantitative analysis to silicon carbide is not less than 70 mass %, silicon carbide is the main ingredient, and such a sintered body is called silicon carbide-based sintered body.

Since the silicon carbide-based sintered body is comparatively high in heat conductivity, the heat exchange efficiency of the heat exchanger can be enhanced, and since the alumina-based sintered body is low in raw material cost and is easy to process compared with a non-oxide sintered body such as the silicon carbide sintered body, the heat exchanger can be manufactured comparatively inexpensively.

The heat exchanger 1 of the example shown in FIG. 1 comprises the heat exchange member 2 of the present embodiment as a flow passage member inside which a first flow passage 8 through which a first fluid flows is formed. In the following description, description will be given with the assumption that all the flow passage members provided in the heat exchanger 1 are the heat exchange member 2 of the present embodiment.

The heat exchanger 1 of the present embodiment comprises three heat exchange members 2 at space intervals therebetween, through which the first fluid flows, the inlet member 3 which communicates with the first flow passage 8 at one end side of each heat exchange member 2 and directs the first fluid into the heat exchange members 2 and the outlet member 4 which communicates with the first flow passage 8 at the other end side of each heat exchange member 2 and directs the first fluid out of the heat exchange members 2, and the space intervals define second flow passages 10 through which a second fluid flows. The one end side and the other end side referred to here indicate one end side and the other end side in a direction in which the first fluid flows.

As the first fluid and the second fluid, a liquid, a gas or the like may be used as appropriate according to the purpose; for example, when the first fluid is a coolant formed of a liquid and the second fluid is a gas such as a hot gas, heat exchange can be performed through the heat exchange members 2.

Next, the heat exchange members 2, which necessarily communicate with the inlet member 3 and the outlet member 4, have openings for the communication with the inlet member 3 and the outlet member 4. In the heat exchanger 1 shown in FIG. 1, the upper heat exchange member 2*a* has openings only on the lower side, and the middle and lower heat exchange members 2*b* and 2*c* have openings on the upper side and the lower side.

When the heat exchange members 2*b* and 2*c* have a through hole 14*a* on the side of the inlet member 3 and a through hole 14*b* on the side of the outlet member 4 as the openings as shown in FIG. 2(*a*), by disposing the inlet member 3 and the outlet member 4 so as to be inserted in these through holes 14*a* and 14*b*, the heat exchange member 2, and the inlet member 3 and the outlet member 4 can be easily combined.

Moreover, when the inlet member 3 and the outlet member 4 are configured by one tubular (for example, cylindrical) member as shown in FIG. 2(*b*), leakage of the first fluid flowing through the inlet member 3 and the outlet member 4 can be effectively suppressed. When the inlet member 3 and the outlet member 4 are one tubular member, respectively, by providing a communicating portion 15 in a part thereof as shown in FIG. 2(*b*), communication with the first flow passage 8 of the heat exchange members 2 can be obtained. The inlet member 3 and the outlet member 4 are not limited to members which extend over a plurality of heat exchange members 2, and it is needless to say that they may be composed of merely cylindrical members disposed between the heat exchange members 2, respectively.

Since the inlet member 3 and the first flow passage 8, and the first flow passage 8 and the outlet member 4 communicate with each other, the first fluid having flowed through the flow passage provided inside the inlet member 3 (hereinafter, referred to as entrance flow passage 7) flows through the first flow passage 8 inside the respective heat exchange members 2, and can exchange heat with the second fluid flowing through the second flow passage 10 while flowing through the first flow passage 8. Moreover, the first fluid having flowed through the first flow passage 8 flows through a flow passage (hereinafter, referred to as exit flow passage 9) provided inside the outlet member 4 and is discharged outside.

In such a path of the first fluid, a part of connection between the inlet member 3 and the first flow passage 8 and a part of connection between the first flow passage 8 and the outlet member 4 are parts where the first fluid is highly likely to leak outside. Here, when the first fluid leaks outside, not only heat exchange efficiency decreases, but also various apparatuses and the like in which the heat exchanger 1 is disposed can be adversely affected according to the kind of the first fluid.

Therefore, it is preferable that, as shown in FIG. 1, a covering member 6 which is disposed between the heat exchange members 2, covers the outer peripheries of the inlet member 3 and the outlet member 4 and has its one end surface and other end surface connected to the heat exchange members 2, is provided. As the shape of the covering member 6, one that is tubular and capable of covering the outer peripheries of the inlet member 3 and the outlet member 4 may be used, and one that becomes tubular by a single member or a combination may be used. In FIG. 2(*c*), a single cylindrical covering member 6 is shown as an example.

As described above, when the covering member 6 is provided, since the possibility that the first fluid leaks outside can be reduced, heat exchange efficiency is not reduced, so that a heat exchanger 1 with improved reliability can be obtained.

While an example in which the inner surface of the covering member 6 abuts on the outer surfaces of the inlet member 3 and the outlet member 4 is shown in FIG. 1(*b*), it is not always necessary for the inner surface to abut thereon; for example, the inner surface of the covering member 6 and the outer surfaces of the inlet member 3 and the outlet member 4 may be disposed with a gap therebetween. When a gap is provided as mentioned above, even if the first fluid leaks from the part of connection between the inlet member 3 and the first flow passage 8 and the part of connection between the first flow passage 8 and the outlet member 4, this gap acts as a storage for storing the leaking first fluid.

Moreover, in FIG. 1(*a*) and FIG. 1(*b*), there is shown an example that a flange portion 5 having an inlet portion 11 which directs the first fluid into the inlet member 3 and a collection portion 12 which collects the first fluid having flowed through the outlet member 4 is provided.

In the heat exchanger 1 having a structure like this, the first fluid directed from one inlet portion 11 of the flange portion 5 flows through the entrance flow passage 7, the first flow passage 8 and the exit flow passage 9 to be discharged from an exit 13 through the collection portion 12.

The inlet portion 11 and the collection portion 12 have only to be provided independently so that the fluids flow through them are not mixed together. Moreover, the inlet portion 11 and the collection portion 12 may form flow passages independent of each other, and the sizes thereof may be set as appropriate. When a flow passage is also formed inside the flange portion 5, since heat exchange can also be performed in the flange portion 5, the heat exchange efficiency of the heat exchanger 1 can be enhanced.

Moreover, when a plurality of heat exchange members 2 are provided, in order to cause the first fluid flowing through the entrance flow passage 7 to more uniformly flow through the first flow passages 8 of the heat exchange members 2*a* to 2*c*, for example, a plate-shaped flow rate regulating member extending toward the entrance side of the entrance flow passage 7 may be provided at the inlet member 3 side end portion of the first flow passage 8, inside the through hole 14, inside the inlet member 3 and the like.

Moreover, while an example in which the entrance flow passage 7 is formed in the same width is shown in FIG. 1(*b*), in order to cause the first fluid flowing through the entrance flow passage 7 to more uniformly flow through the first flow passages 8 of the heat exchange members 2*a* to 2*c*, a form in which the width decreases or the width increases from the entrance side toward the exit side of the first fluid in the entrance flow passage 7, may be adopted.

Further, while an example in which one entrance flow passage 7 and one first flow passage 9 are provided is shown in the heat exchanger 1 of FIG. 1(*a*) and FIG. 1(*b*), according to the size and the like of the heat exchange member 2, the number of openings is increased and the inlet member 3 and the outlet member 4 according thereto are used, whereby more than one entrance flow passage 7 and first flow passage 9 can be provided.

While in performing efficient heat exchange in the heat exchanger 1, it is preferable to make arrangement so that the flows of the first fluid and the second fluid are counter to each other, it is not always necessary to make arrangement so that they are counter to each other; for example, arrangement may be made as appropriate according to the flows of the target fluids such as making arrangement so that they cross each other or making arrangement so that the fluids flow in the same direction.

Moreover, the above-described heat exchanger 1 is not specifically limited in use but may be applied as appropriate to, for example, not only various kinds of laser devices but also one that performs heat exchange. Further, while description is given with the assumption that all the flow passage members provided in the heat exchanger 1 are the heat exchange member 2 of the present embodiment, it is needless to say that at least one of the flow passage members constituting the heat exchanger 1 is composed of the heat exchange member 2 of the present embodiment, whereby similar effects described below can be obtained.

Figure 3:
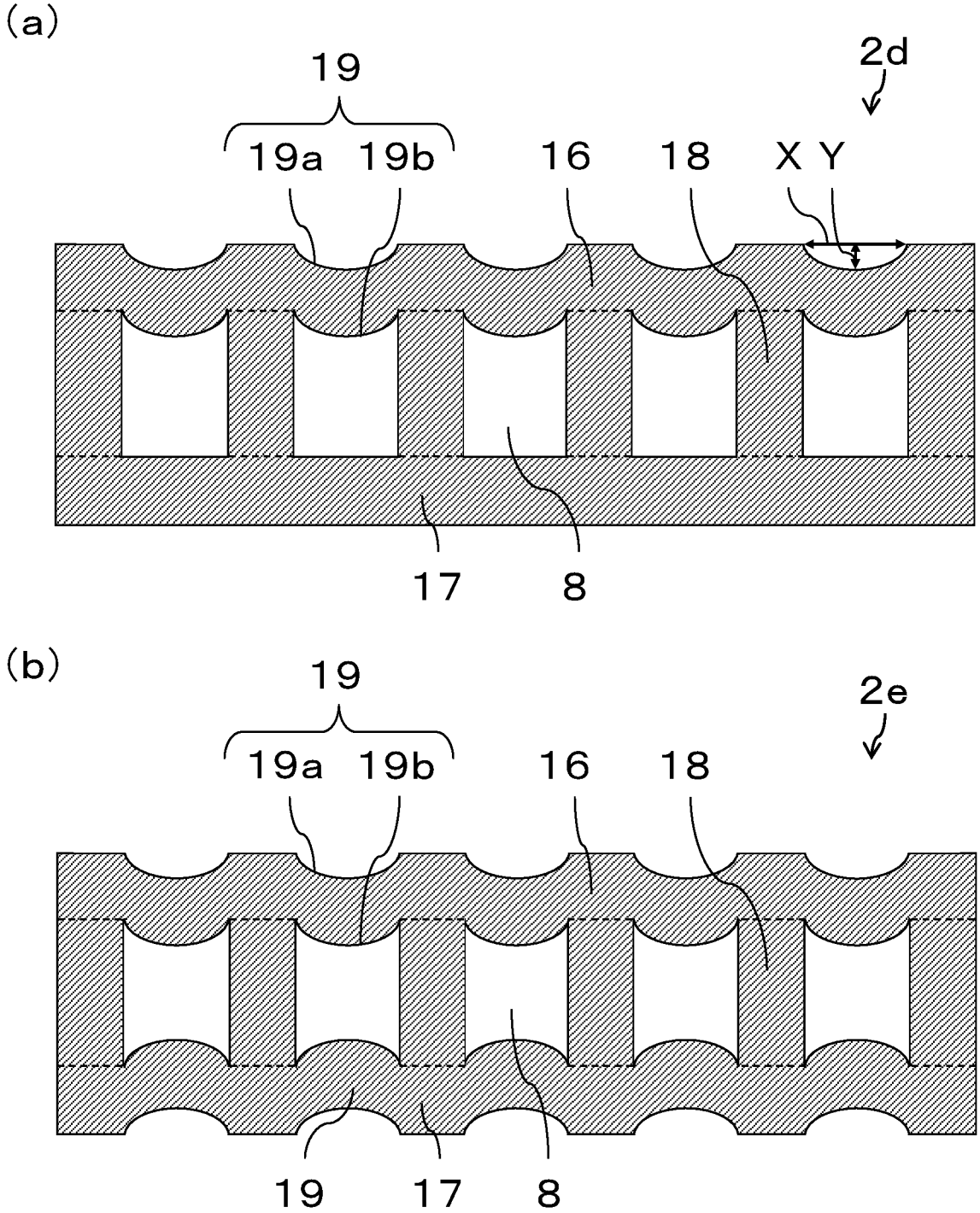
FIG. 3(*a*) is a cross-sectional view perpendicular to a direction in which a first fluid flows, which view shows another example of the heat exchange member of the present embodiment, and FIG. 3(*b*) is a cross-sectional view perpendicular to the direction in which the first fluid flows, which view shows still another example of the heat exchange member of the present embodiment.

FIG. 3(*a*) and FIG. 3(*b*) are cross-sectional views perpendicular to the direction in which the first fluid flows which views show an example of the heat exchange member of the present embodiment. In the following description, when based on a specific view, description will be given while assigning the reference numerals assigned in the specific view, and in other cases, description will be given while referring to it as the heat exchange member 2.

A heat exchange member 2*d* shown in FIG. 3(*a*) and a heat exchange member 2*e* shown in FIG. 3(*b*) comprise a lid portion 16, a bottom plate portion 17 and partition portions 18 disposed so as to connect the lid portion 16 and the bottom plate portion 17, and parts surrounded by the lid portion 16, the bottom plate portion 17 and the partition portions 18 define the first flow passages 8 through which the first fluid flows. In FIG. 3(*a*) and FIG. 3(*b*), for convenience' sake, parts which are boundaries between the lid portion 16 and the partition portions 18 and between the bottom plate portion 17 and the partition portions 18 are indicated by broken lines.

Moreover, while examples having five first flow passages 8 are shown in FIG. 3(*a*) and FIG. 3(*b*), the number of first flow passages 8 is not specifically limited; for example, it may be one or may be six or more, and may be set as appropriate according to the required heat exchange performance. Further, it is preferable that the partition portions 18 extend from one end side to the other end side in the direction in which the first fluid flows in the first flow passages 8, and thereby, a surface area where the first fluid and the partition portions 18 are in contact can be made large, so that heat exchange efficiency can be improved.

The heat exchange member 2 of the present embodiment comprises curved portions 19 curved toward the first flow passages 8 on the first flow passage 8 side of at least one of the lid portion 16 and the bottom plate portion 17 when viewed in a cross section perpendicular to the direction in which the first fluid flows. In FIG. 3(*a*), an example in which the curved portions 19 are provided only on the lid portion 16 is shown, and in FIG. 3(*b*), an example in which they are provided on both the lid portion 16 and the bottom plate portion 17 is shown. By satisfying such a structure, the surface areas of the outer surfaces 19*a* and the inner surfaces 19*b* of the curved portions 19 are large compared with the surfaces when there are no curves, so that heat exchange efficiency can be improved; it is needless to say that a structure in which the curved portions 19 are provided only on the bottom plate portion 17 may be adopted.

Moreover, for example, in the case of a structure in which the second fluid flows on the outer surface side of the lid portion 16, when the flow of the second fluid is along the flow of the first fluid, the second fluid easily flows along the curved portions 19, so that heat exchange efficiency is improved. Moreover, in the case of a structure in which the flow of the second fluid is orthogonal to the flow of the first fluid, when the second fluid having entered the curved portions 19 to be heat-exchanged exits from the curved portions 19, heat exchange is performed at the time of contact with the second fluid passing thereabove, so that heat exchange efficiency is improved.

While an example in which parts immediately above all the first flow passages 8 of the lid portion 16 are curved is shown in FIG. 3(*a*) and an example in which parts immediately above all the first flow passages 8 of the lid portion 16 and parts immediately below all the first flow passages 8 of the bottom plate portion 17 are curved is shown in FIG. 3(*b*), a structure in which only some are curved may be adopted, and, from the viewpoint of improvement in heat exchange, it is preferable that a large number of curved portions 19 are provided.

While the curvature of the curved portions 19 may be set as appropriate in consideration of the strengths of the lid portion 16 and the bottom plate portion 17, for example, as shown in FIG. 3(*a*), when the points immediately above the first flow passage 8 and on the extensions of the inner surfaces of the partition portions 18 are the starting points of the curved portion 19, X denotes the length connecting these points by a straight line and Y denotes the length of the perpendicular from the apex of the curved portion 19 to the straight line, it is preferable that Y/X is in a range of $1\times10^{-4}$ to $5\times10^{-2}$. Specifically, when X is 20 mm, Y is 2 μm to 1 mm.

The above-described curvature (Y/X) of the curved portions 19 can be calculated, for example, by performing measurement from one starting point to the other starting point of the curved portion 19 using a commercially available contour shape measuring instrument, measuring the length (X) of the straight line connecting the starting points, measuring the length (Y) of the perpendicular from the apex of the curved portion 19 to the straight line and performing calculation using these values.

Figure 4:
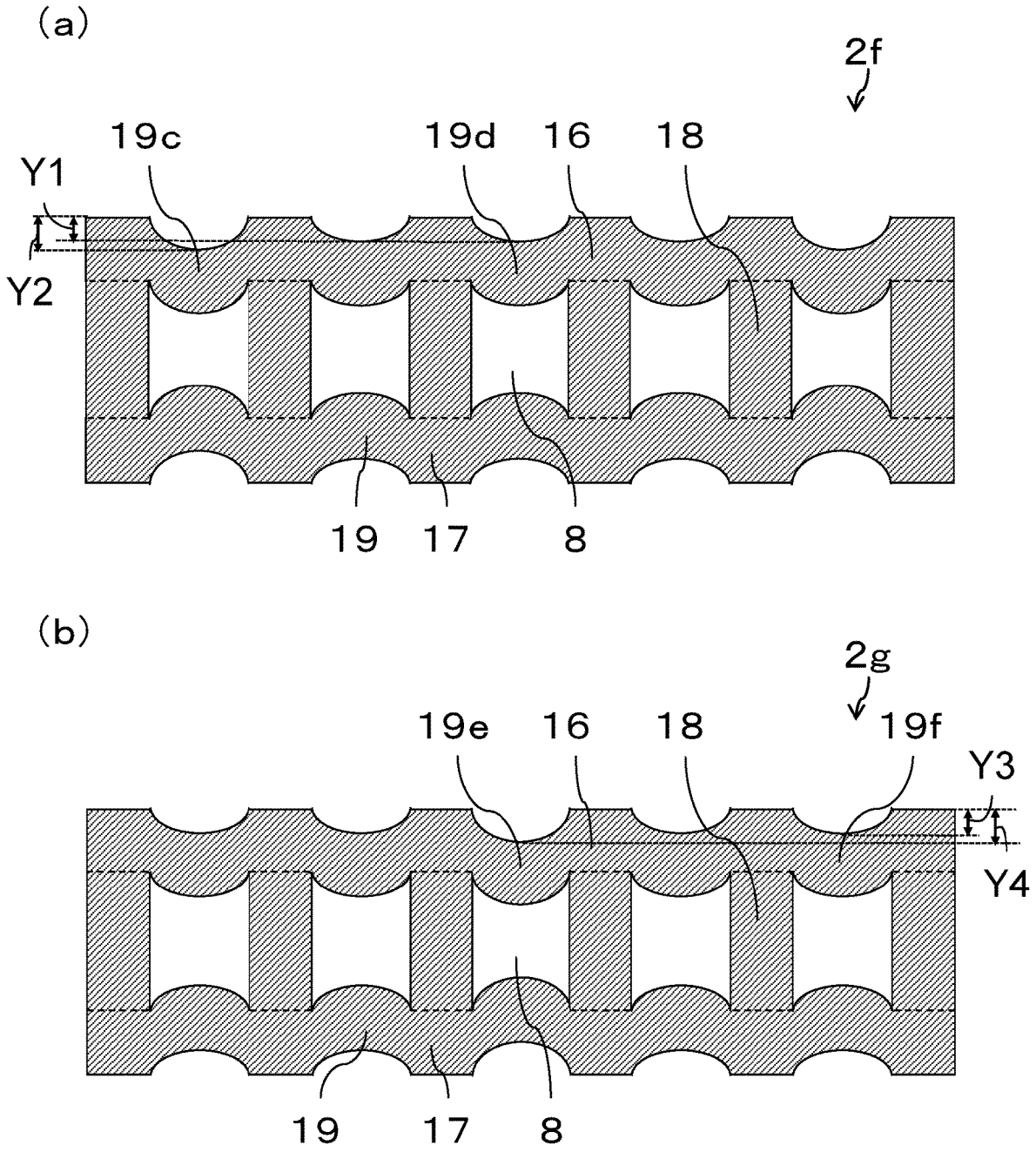
FIG. 4(*a*) is a cross-sectional view perpendicular to the direction in which the first fluid flows, which view shows another example of the heat exchange member of the present embodiment, and FIG. 4(*b*) is a cross-sectional view perpendicular to the direction in which the first fluid flows which view shows still another example of the heat exchange member of the present embodiment.

FIG. 4(*a*) and FIG. 4(*b*) are cross-sectional views perpendicular to the direction in which the first fluid flows which views show other examples of the present embodiment.

For example, when in the heat exchange member 2, the number of portions serving as the entrance and exit of the first fluid is one, the number of first flow passages 8 provided is more than one, for example, five as shown in FIG. 4(*a*) and FIG. 4(*b*) and the path of the first fluid is provided over a wide area inside the heat exchange member 2, the length of the flow passage of the first flow passage 8 situated outside is larger than the length of the flow passage of the first flow passage 8 situated inside. In such a structure, the flow speed of the first fluid flowing through the first flow passages 8 is apt to differ between outside and inside and a difference occurs in heat exchange between outside and inside, so that there is a possibility that a temperature distribution occurs in the heat exchange member 2.

When the flow speed of the first fluid on the inside is high and the flow speed on the outside is low, like a heat exchange member 2*f* shown in FIG. 4(*a*), the curvature of a curved portion 19*c* situated outside is higher than the curvature of a curved portion 19*d* situated inside, whereby the temperature distribution difference can be made small. In FIG. 4(*a*), a relation Y1<Y2 holds.

While an example in which the curvature of the curved portion 19*c* situated on the outermost side is higher than the curvature of the curved portion 19*d* situated inside is shown in FIG. 4(*a*), a structure may be adopted in which the curvature gradually decreases from the outside toward the inside.

On the other hand, when the flow speed of the first fluid on the outside is high and the flow speed on the inside is low, like a heat exchange member 2*g* shown in FIG. 4(*b*), the curvature of a curved portion 19*e* situated inside is higher than the curvature of a curved portion 19*f* situated outside, whereby the temperature distribution difference can be made small. In FIG. 4(*b*), a relation Y3<Y4 holds.

While an example in which the curvature of the curved portion 19*e* situated in the center which is the innermost side is higher than the curvature of the curved portion 19*f* situated outside is shown in FIG. 4(*b*), a structure may be adopted in which the curvature gradually decreases from the inside toward the outside.

Since, in the heat exchanger 1 of the present embodiment, at least one of the flow passage members which are the first flow passages 8 inside which the first fluid flows is composed of the heat exchange member 2 of the present embodiment, the heat exchanger 1 has excellent heat exchange efficiency. Moreover, it is preferable that all the flow passage members are composed of the heat exchange member 2 of the present embodiment. Further, it is more preferable that all the heat exchange members 2 constituting the heat exchanger 1 of the present embodiment are composed of the heat exchange member 2 in which the curved portions 19 are provided on both of the lid portion 16 and the bottom plate portion 17.

Next, a method of producing the heat exchange member 2 of the present embodiment will be described.

For example, a sintering aid, a binder, a solvent, a dispersant and the like are added in desired amounts and mixed to powder of the raw material (silicon carbide, alumina, etc.) as the main ingredient, thereby producing slurry. Then, using this slurry, a ceramic green sheet is formed by a doctor blade method, and this ceramic green sheet is punched with a die, thereby obtaining sheet-like compacts of desired shapes. Specifically, they are a compact in which only an external shape is punched and a compact in which a part corresponding to the first flow passage is punched (compact serving as the partition portion). Then, a curved portion is formed by performing cutting on the compact in which only the external shape is punched or a curved portion is formed by pressing onto a die having a convex portion capable of forming a curved portion of the desired shape, thereby obtaining a compact serving as the lid portion and/or a compact serving as the bottom plate portion.

Then, by lamination in the order of the compact serving as the bottom plate portion, the compact serving as the partition portion and the compact serving as the lid portion with the above-mentioned slurry as the adhesive agent, a laminated compact is obtained. As another method of producing the ceramic green sheet, it may be performed to granulate the slurry by spray-drying it by a spray granulation method (spray dry method) to thereby form granules and perform production with the granules by a roll compaction method.

Moreover, as another method of producing the compact, it may be performed to adjust the slurry to a green body and perform production by an extrusion method. Further, the compact serving as the bottom plate, the compact serving as the partition portion and the compact serving as the lid portion may be produced by performing shaping by a mechanical pressing method or a cold isostatic pressing (CIP) method using granules and performing cutting.

In forming the curved portion, the curved portion may be formed by, first, obtaining a laminated compact using a compact in which only the external shape is punched and a compact serving as the partition portion and then, pressing this laminated compact while sandwiching it with a die having a convex portion capable of forming a curved portion of a desired shape. Further, the curved portion may be formed by preparing a laminated compact in which no curved portions are formed and a compact obtained by the extrusion method and letting them stand after vacuuming a space serving as the first flow passage.

By firing the compact obtained as described above at a temperature according to the main ingredient constituting the raw material, a sintered body serving as the heat exchange member having curved portions of the present embodiment can be obtained.

Next, a method of producing the heat exchanger of the present embodiment will be described. Regarding the heat exchange member, description of the production method is omitted as it is duplication.

First, the inlet member, the outlet member, the covering member and the flange portion are individually produced.

For example, a sintering aid, a binder, a solvent, a dispersant and the like are added in desired amounts and mixed to powder of the raw material (silicon carbide, alumina, etc.) as the main ingredient constituting the members, thereby producing slurry. Then, using this slurry, a ceramic green sheet is formed by the doctor blade method, and this ceramic green sheet is punched with a die, thereby obtaining sheet-like compacts of desired shapes. Alternatively, sheet-like compacts of desired shapes may be obtained by granulating the slurry by spray-drying it by the spray granulation method to thereby form granules, forming the ceramic green sheet with the granules by the roll compaction method and punching this ceramic green sheet with a die. Then, with the slurry as the adhesive agent, the sheet-like compacts are laminated into a laminated compact.

As another method of producing the compact, it may be performed to adjust the slurry to a green body and perform production by the extrusion method. For the production of tubular members such as the inlet member, the outlet member and the covering member, the extrusion method is useful. Then, by firing the obtained compact at a temperature according to the main ingredient constituting the raw material, the inlet member, the outlet member, the covering member and the flange member can be obtained.

The above-mentioned members may be formed by the production by the mechanical pressing method or the cold isostatic pressing method using granules and joining at the compacts, bonding after firing or the like.

Next, the method of assembling the heat exchanger 1 of FIG. 1 will be described. First, the inlet member 3 and the outlet member 4 are inserted into the openings provided on the heat exchange member 2*a*. Then, the covering members 6 are inserted on the inlet member 3 and the outlet member 4. Further, the heat exchange member 2*b*, the covering members 6, the heat exchange member 2*c* and the covering members 6 are inserted, and lastly, the flange portion 5 is connected. By inserting the members with an adhesive agent or the like applied thereto and finally, performing heat treatment on the produced article, the heat exchanger 1 of the present embodiment can be obtained. The formation may be performed by laminating the heat exchange members 2 and the covering members 6 and then, inserting the inlet member 3 and the outlet member 4.

Here, as the adhesive agent to be used, for example, $SiO_2$—$Al_2O_3$—$B_2O_3$—RO glass (R: alkaline-earth metal element) powder which is an inorganic adhesive agent excellent in heat resistance and corrosion resistance, a paste containing ceramic powder in which metal silicon powder and silicon carbide powder are mixed, or the like is used. When such an inorganic adhesive agent is used as the adhesive agent, since the heat treatment temperature is low, the members constituting the heat exchanger 1 are hardly deteriorated when heat treatment is performed, and the members can be firmly joined together, so that the reliability of the heat exchanger 1 can be improved.

To improve the corrosion resistance of the heat exchanger 1, a covering layer containing any one of Ni, Cu, Al and Cr as the main ingredient may be formed on the heat exchanger 1 by an electroless plating method or a plasma spraying method.

While the invention is described above in detail, the invention is not limited to the above-described embodiment and various modifications, improvements and the like are possible without departing from the scope of the invention.

For example, for the heat exchange member 2 disposed more than one in number, heat exchange members 2 of different curvatures may be used, or the curvatures situated at the opposed parts of the heat exchange members 2 may be increased or decreased by varying the distance between the heat exchange members 2.

While description is given as the heat exchanger 1 in which a plurality of heat exchange members 2 of the present embodiment are combined, the heat exchange member 2 itself may be used as a heat exchanger, for example, a heat exchanger for a semiconductor element or for a semiconductor manufacturing apparatus.

REFERENCE SIGNS LIST

1: Heat exchanger
2: Heat exchange member
3: Inlet member
4: Outlet member
5: Flange portion
6: Covering member
7: Entrance flow passage
8: First flow passage
9: Exit flow passage
10: Second flow passage
16: Lid portion
17: Bottom plate portion
18: Partition portion
19: Curved portion

The invention claimed is:

1. A heat exchange member, comprising:

a ceramic sintered body comprising:

a lid portion;

a bottom plate portion;

outer side walls;

a central portion centered between the outer side walls; and a plurality of partition portions connecting the lid portion, the bottom plate portion; and a space surrounded by the lid portion, the bottom plate portion and the outer side walls, the space defining a passage through which a first fluid flows, the plurality of partition portions located in the space, wherein a first flow passage is formed between two adjacent partition portions among the plurality of partition portions and a second flow passage is formed between another two adjacent partition portions among the plurality of partition portions, the second passage being closer to the central portion than the first passage, the lid portion comprises:

an outer surface and an inner surface that is closer to the bottom plate portion than the outer surface;

a first curved portion having a first curvature, is between the two adjacent partition portions, and wherein the inner and outer surfaces are curved toward the bottom plate portion; and a second curved portion having a second curvature, is between another two adjacent partition portions, and wherein the inner and outer surfaces are curved toward the bottom plate portion and the second curvature is different from the first curvature, wherein the curvatures are defined as Y/X where X is a length of a first straight line connecting two starting points which are above inner surfaces of said adjacent partition portions, respectively, and Y is a length of a second straight line from the first straight line to an apex of the curved portion wherein the second straight line is perpendicular to the first line.

2. The heat exchange member according to claim 1, further comprising a third passage between the first passage and the second passage, and wherein the first curvature is greater than the second curvature.

3. The heat exchange member according to claim 2, wherein the first and second curved portions have a smooth curved surface.

4. The heat exchange member according to claim 2, further comprising a third curved portion curved toward the third passage with a third curvature, wherein the first curvature is greater than the third curvature, and the third curvature is greater than the second curvature.

5. The heat exchange member according to claim 1, further comprising a third passage between the first passage and the second passage, and wherein the second curvature is greater than the first curvature.

6. The heat exchange member according to claim 5, wherein the first and second curved portions have a smooth curved surface.

7. The heat exchange member according to claim 5, further comprising a third curved portion curved toward the third passage with a third curvature; and the second curvature is greater than the third curvature, and the third curvature is greater than the first curvature.

8. A heat exchanger, comprising:

a plurality of flow passage members at space intervals therebetween, through which a first fluid flows, the space intervals defining second flow passages through which a second fluid flows, at least one of the flow passage members being composed of the heat exchange member according to claim 1;

an inlet member which communicates with the first flow passage at one end sides of the respective flow passage members and directs the first fluid into the respective flow passage members; and an outlet member which communicates with the first flow passage at another end sides of the respective flow passage members and directs the first fluid out of the respective flow passage members.

9. The heat exchanger according to claim 8, further comprising covering members which are disposed between the flow passage members, and cover outer peripheries of the inlet member and the outlet member, wherein one end surface of each of the covering members is connected to one flow passage member of the flow passage members and another end surface thereof is connected to a flow passage member adjacent to the one flow passage member of the flow passage members.

10. The heat exchange member according to claim 8, wherein the flow passage members each have openings on one end side and another end side thereof, and the inlet member and the output member are inserted in the openings.

11. The heat exchanger according to claim 8, further comprising a flange portion having an inlet portion which directs the first fluid into the inlet member and a collection portion which collects the first fluid having flowed through the outlet member.

12. The heat exchanger according to claim 8, wherein a volume of a flow passage in the outlet member is larger than a volume of a flow passage in the inlet member.

13. A heat exchanger, comprising:

the heat exchange member according to claim 1.

14. The heat exchange member according to claim 1, wherein the at least one curved portion has a smooth curved surface.

* * * * *